US010136745B1

(12) United States Patent
Reed

(10) Patent No.: US 10,136,745 B1
(45) Date of Patent: Nov. 27, 2018

(54) EATING UTENSIL

(71) Applicant: Max W. Reed, Niwot, CO (US)

(72) Inventor: Max W. Reed, Niwot, CO (US)

(73) Assignee: VISTA MOUNTAIN GEAR, LLC, Niwot, CO (US)

( * ) Notice: Subject to any disclaimer, the term of this patent is extended or adjusted under 35 U.S.C. 154(b) by 0 days.

(21) Appl. No.: 15/870,915

(22) Filed: Jan. 13, 2018

Related U.S. Application Data

(60) Provisional application No. 62/610,276, filed on Dec. 25, 2017.

(51) Int. Cl.
*A47G 21/02* (2006.01)
*A47G 21/06* (2006.01)
*A47G 21/10* (2006.01)

(52) U.S. Cl.
CPC ..... *A47G 21/02* (2013.01); *A47G 21/023* (2013.01); *A47G 21/06* (2013.01); *A47G 21/103* (2013.01)

(58) Field of Classification Search
CPC .... A47G 21/02; A47G 21/023; A47G 21/103; A47G 21/10; A47G 21/06; A47J 43/283
USPC ..... 294/3, 99.2, 218; 30/142; D7/643, 644
See application file for complete search history.

(56) References Cited

U.S. PATENT DOCUMENTS 282,105 A * 7/1883 Murchison
2,839,830 A * 6/1958 Neiman, Jr. ..... A47G 21/06 30/147
3,323,825 A 6/1967 Arima
3,727,306 A * 4/1973 Patik ..... A47G 21/04 294/3
3,807,781 A 4/1974 Rollband
4,182,032 A * 1/1980 Newport ..... A47G 21/023 30/137
4,521,964 A 6/1985 Maruyama
4,576,408 A 3/1986 Maneki
4,659,128 A 4/1987 Dong
4,721,334 A 1/1988 Nakatsu
4,787,663 A 11/1988 Laramie
4,809,435 A 3/1989 Printz
4,973,095 A 11/1990 Kunihisa
5,056,173 A 10/1991 Brincat
5,373,640 A 12/1994 Cordeiro
5,486,029 A 1/1996 Kobayashi
5,649,728 A 7/1997 Warthen
5,697,659 A 12/1997 Calagui
5,791,053 A 8/1998 Koong
5,911,462 A 6/1999 Hui
6,056,342 A * 5/2000 Chan ..... A47G 21/10 294/33

(Continued)

FOREIGN PATENT DOCUMENTS

WO 2007049887 A1 5/2007
WO WO-2007049887 A1 * 5/2007 ..... A47G 21/06

*Primary Examiner* — Dean J Kramer
(74) *Attorney, Agent, or Firm* — Nicholas J. Boyarski

(57) ABSTRACT

Eating utensils disclosed herein provide desirable aspects of a fork and chopsticks and also provide improved dexterity that enables functionality not possible with either a fork or chopsticks. The eating utensils allow a user to grasp, shovel, and pierce food as well as scoop under food from one side or both sides and to cut food with a side edge, all with a single utensil operated with one hand. Because of the unique way the eating utensil is held and operated, it feels natural to both traditional fork users and chopsticks users.

20 Claims, 15 Drawing Sheets

(56) References Cited

U.S. PATENT DOCUMENTS

| | | | | |
|---|---|---|---|---|
| 6,749,239 | B2 | 6/2004 | Choi | |
| 7,017,964 | B2 | 3/2006 | Hao | |
| 7,052,061 | B2 | 5/2006 | Calagui | |
| 7,234,745 | B1 | 6/2007 | Tsai | |
| 7,878,563 | B2 | 2/2011 | Beckham et al. | |
| 8,333,418 | B2 | 12/2012 | Gosai | |
| 8,459,708 | B1 * | 6/2013 | Sandorfi | A47J 43/283 294/104 |
| 8,672,377 | B2 | 3/2014 | Ina | |
| 8,727,408 | B1 | 5/2014 | Ruid | |
| 9,004,566 | B2 | 4/2015 | Pecoraro | |
| 9,468,322 | B2 | 10/2016 | Woo | |
| 2004/0051327 | A1 * | 3/2004 | Yoon | A47G 21/103 294/99.2 |
| 2005/0155229 | A1 | 7/2005 | Lee | |
| 2006/0260136 | A1 * | 11/2006 | Houle | A47G 21/023 30/142 |
| 2007/0006465 | A1 * | 1/2007 | Lee | A47G 21/02 30/142 |
| 2008/0022534 | A1 * | 1/2008 | Kim | A47G 21/02 30/142 |
| 2008/0030034 | A1 * | 2/2008 | Balaciano | A47J 43/283 294/3 |
| 2008/0036226 | A1 | 2/2008 | Yoon | |
| 2009/0165307 | A1 * | 7/2009 | Lam | A47G 21/023 30/123 |
| 2009/0241347 | A1 | 10/2009 | Weaver | |
| 2010/0299932 | A1 | 12/2010 | Misawa | |
| 2011/0035946 | A1 | 2/2011 | Menceles | |
| 2011/0169286 | A1 | 7/2011 | Huang | |
| 2014/0173909 | A1 | 6/2014 | Chong | |
| 2014/0265402 | A1 | 9/2014 | Pecoraro | |
| 2014/0319865 | A1 | 10/2014 | Tran | |
| 2015/0014329 | A1 | 1/2015 | Konopatsky | |
| 2016/0235253 | A1 | 8/2016 | Aghamalian | |
| 2017/0027353 | A1 | 2/2017 | Merkurieff | |
| 2017/0055744 | A1 | 3/2017 | Acosta et al. | |

* cited by examiner

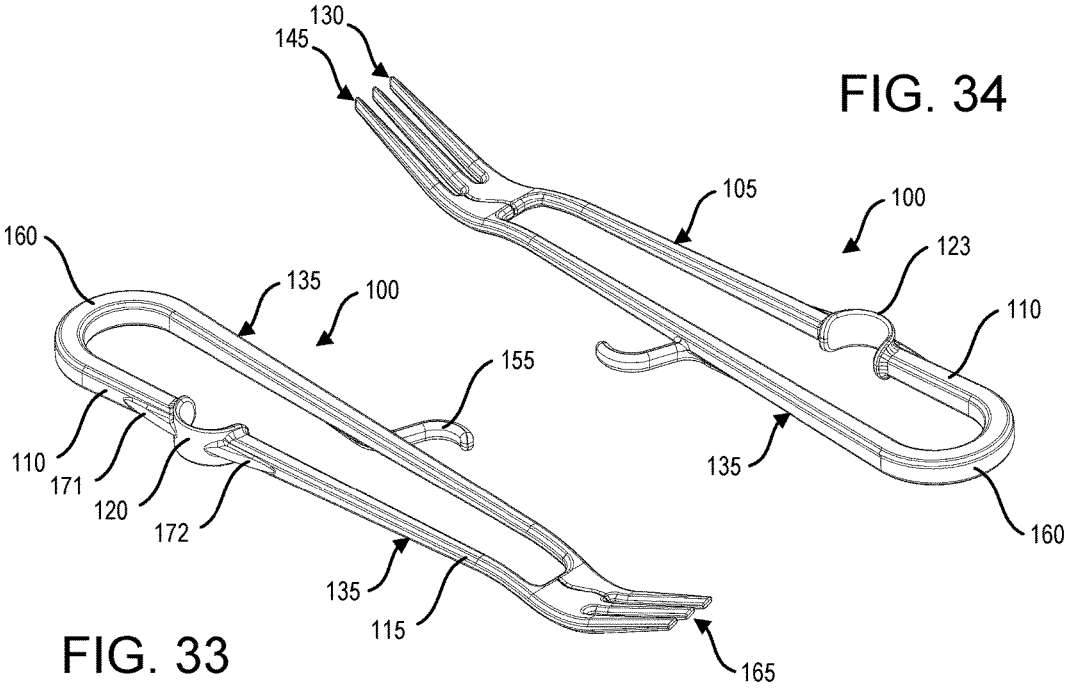
FIG. 34
FIG. 33
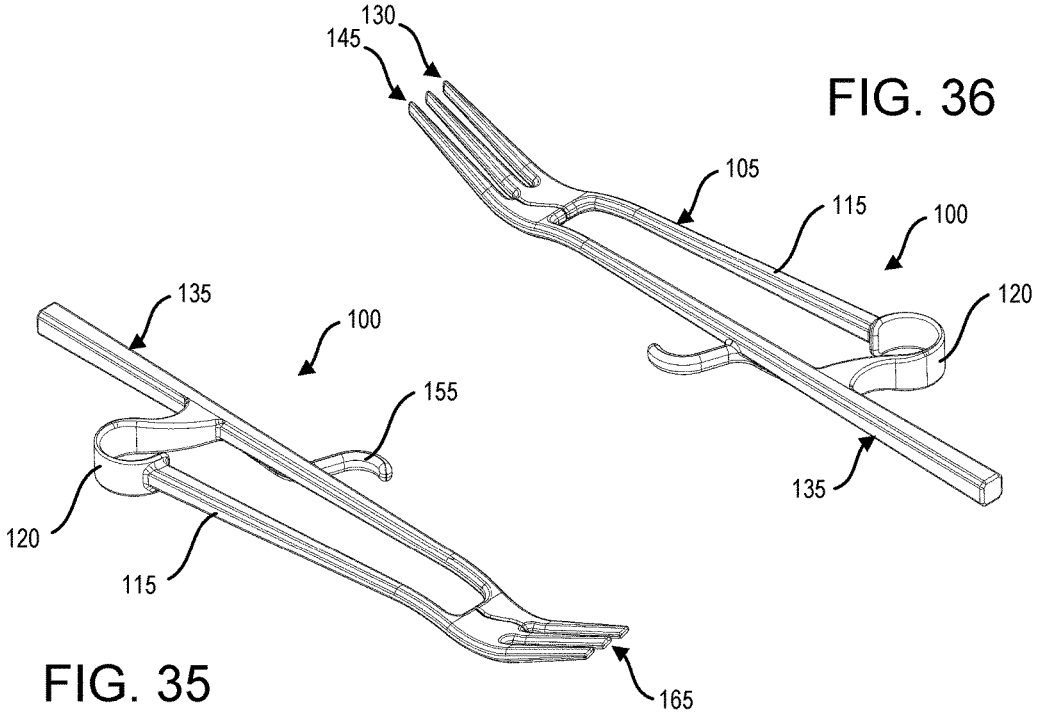
FIG. 36
FIG. 35

EATING UTENSIL

CROSS-REFERENCE TO RELATED APPLICATION

This application claims the benefit of U.S. Provisional Patent Application No. 62/610,276 filed on Dec. 25, 2017, which is hereby incorporated by reference in its entirety as if fully set forth in this description.

FIELD

This disclosure relates to eating utensils. More specifically, this disclosure relates to eating utensils with desirable aspects of forks and chopsticks.

BACKGROUND

Two of the most popular eating utensils in the world are forks and chopsticks. While each of these utensils has desirable aspects that have led to its respective popularity, each also has shortcomings that users contend with on a daily basis. For example, forks are unable to grasp food or scoop under food from both sides. When using a fork, a user often needs a knife or other utensil to help encourage food onto the fork. Chopsticks are unable to cut or pierce food or scoop under small pieces of food. In view of these limitations, there is a need for a new eating utensil that provides all desirable aspects of forks and chopsticks while overcoming their respective shortcomings.

BRIEF DESCRIPTION OF THE DRAWINGS

FIG. 33 shows a perspective view of an alternative embodiment of an eating utensil with a curved cross member connecting a lower elongated member to an upper elongated member.

FIG. 34 shows a perspective view of the alternative embodiment of FIG. 33.

FIG. 35 shows a perspective view of an alternative embodiment of an eating utensil with a hinge connected directly to a lower elongated member.

FIG. 36 shows a perspective view of the alternative embodiment of FIG. 35.

BRIEF SUMMARY

Figure 1:
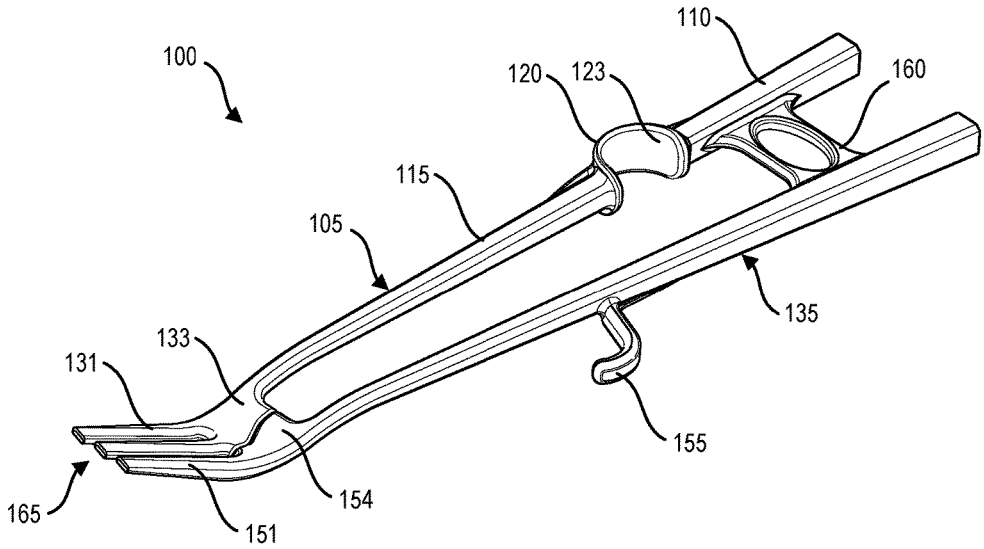
FIG. 1 shows a front perspective view of an eating utensil in a closed position.

The eating utensils disclosed herein combine aspects of a fork and chopsticks with movements similar to traditional chopsticks for improved dexterity. Because of the unique way the eating utensils are held and operated, they feel natural to both traditional fork and chopsticks users.

Unlike a fork or chopsticks, the eating utensils disclosed herein allow users to grasp, shovel, and pierce food as well as scoop under food from one side or both sides and to cut food with a side edge, all with a single utensil operated with one hand.

The eating utensils were developed after studying the natural hand movements of traditional chopsticks users. The eating utensils include a hinge that provides unique functionality that allows a utensil with one-piece construction to mimic both movement and feel of two independent chopsticks. This is accomplished, in part, by providing a pivot point location that replicates the pivot point location of traditional chopsticks and by providing a novel hinge design that restricts out-of-plane motion to ensure proper alignment of the tine ends of the eating utensil.

When in a normally closed position, the eating utensil forms a fork end that can be comfortably used by traditional fork users without the need for any learned hand movements. The eating utensil transitions easily from the closed position to an open position through a simple hand movement that mimics the use of chopsticks. The eating utensil then functions like chopsticks when transitioned between the open and closed positions. When switching between fork and chopstick functionality, the eating utensil does not need to be reconfigured in any way or repositioned in the user's hand.

In one example, an eating utensil can be operable with one hand and capable of scooping under food from opposing directions. The eating utensil can include a lower elongated member having a lower tine end, an upper elongated member having a stationary portion, a movable portion with an upper tine end, and a hinge between the stationary portion and the movable portion. The eating utensil can include a cross member connecting the lower elongated member to the stationary portion of the upper elongated member. The hinge can have a spring force configured to maintain the eating utensil in a closed position with the upper tine end of the movable portion of the upper elongated member in contact with the lower tine end of the lower elongated member to form a fork end when the eating utensil is in the closed position. The movable portion of the upper elongated member can be movable relative to the lower elongated member by actuation of the hinge, thereby allowing the eating utensil to transition between an open position and the closed position and thereby grasp food between the upper and lower tine ends and scoop under food from opposing directions.

In another example, an eating utensil can include a lower elongated member and an upper elongated member. The lower elongated member can be configured to be held in a trough between a thumb and index finger and extend beyond and be supported by a ring finger. The upper elongated member can include a stationary portion, a movable portion, and a hinge between the stationary and movable portions, where the movable portion is held between a thumb, index finger, and middle finger, and where the stationary portion of the upper elongated member is connected to the lower elongated member. A spring force of the hinge can maintain the eating utensil in a closed position with a first tine end of the movable portion of the upper elongated member in contact with a second tine end of the lower elongated member to form a fork end. The movable portion of the upper elongated member can be movable relative to the stationary portion of the upper elongated member by actuation of the hinge to transition the eating utensil to an open position where the upper tine end is spaced apart from the lower tine end to allow grasping food between the upper and lower tine ends.

In yet another example, an eating utensil can be operated as a fork or chopsticks with one hand without reconfiguring or repositioning the eating utensil. The eating utensil can include a lower elongated member and an upper elongated member. The lower elongated member can have a lower tine end and one or more tines extending from the lower tine end. The upper elongated member can have an upper elongated member having a movable portion with an upper tine end. The movable portion can be connected to a hinge, and the hinge can be connected to the lower elongated member. The hinge can be configured to maintain the eating utensil in a normally closed position with the upper tine end in contact with the lower tine end to form a fork end and enable the eating utensil to function as a fork when in the closed position. Applying a separating force to the movable portion of the upper elongated member transitions the eating utensil to an open position where the upper tine end is spaced apart from the lower tine end to enable the eating utensil to function as chopsticks.

DETAILED DESCRIPTION

A new type of eating utensil 100 is shown in the figures and described herein. The eating utensil 100 combines features of a fork with features and natural hand movements associated with traditional chopsticks to provide an eating utensil that, after only a short learning curve, feels natural to both traditional fork users and traditional chopsticks users.

Table 1 shows a comparison of capabilities and shortcomings of traditional forks and chopsticks versus an eating utensil 100 described herein. Although traditional forks are capable of shoveling and piercing food, scooping under food from one side, and cutting food with a side edge, they are unable to grasp food or scoop under food from both sides. Therefore, when using a fork, a user may need to also employ a second utensil, such as a knife, to encourage food onto the fork. Traditional chopsticks also have shortcomings. While traditional chopsticks are capable of grasping food, they are not capable of shoveling, piercing, scooping under food from one or both sides, or cutting food. Moreover, traditional chopsticks can be difficult for traditional fork users to use effectively, which can lead to frustration.

TABLE 1

| Capability/Consideration | Fork | Chopsticks | Eating Utensil |
|---|---|---|---|
| Grasping | No | Yes | Yes |
| Shoveling | Yes | No | Yes |
| Piercing | Yes | No | Yes |
| Scooping under from one side | Yes | No | Yes |
| Scooping under from both sides | No | No | Yes |
| Cutting using a side edge | Yes | No | Yes |
| Spreading apart/Separating | No | Yes | Yes |
| Easy for traditional fork user to use | Yes | No | Yes |
| Easy for traditional chopsticks user to use | No | Yes | Yes |

As detailed in Table 1, the eating utensil 100 described herein combines all desirable capabilities of traditional forks and chopsticks and is easy for both traditional fork and chopsticks users to use. The eating utensil 100 also provides an additional desirable capability of allowing a user to scoop under food from both sides, thereby enabling a new type of dexterity not previously available to users of either forks or chopsticks.

Figure 5:
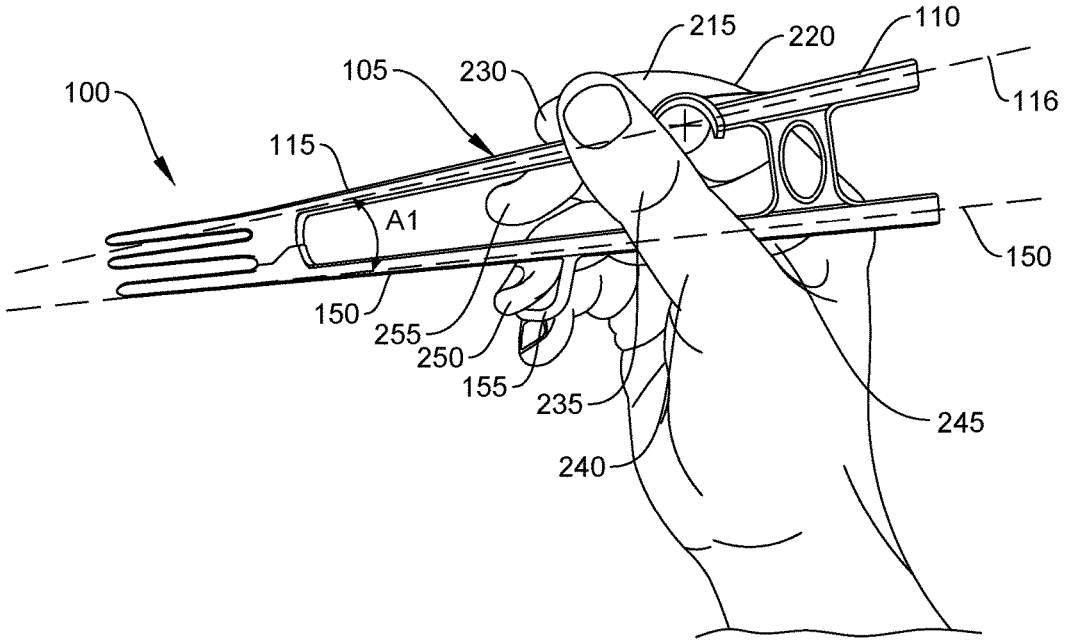
FIG. 5 shows the eating utensil of FIG. 1 held by a user in a normally closed position.
Figure 6:
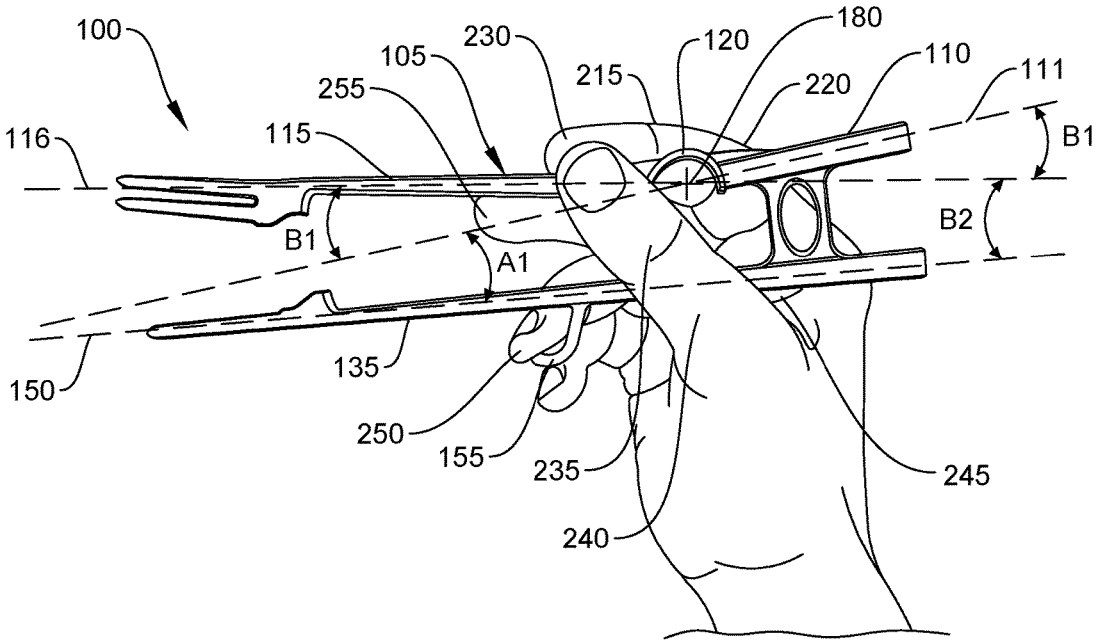
FIG. 6 shows the eating utensil of FIG. 1 held in an open position by a user who is applying a separating force to a movable portion of the eating utensil resulting in actuation of a hinge.

The eating utensil 100 can transition between an open position, shown in FIG. 5, and a closed position, shown in FIG. 6. When in the closed position, the eating utensil functions like a fork. When transitioned between the open and closed positions, the eating utensil functions like chopsticks.

The eating utensils 100 shown in FIGS. 1-36 are adapted for use with a user's right hand. A mirror image of each eating utensil can be provided for use with a user's left hand.

Figure 2:
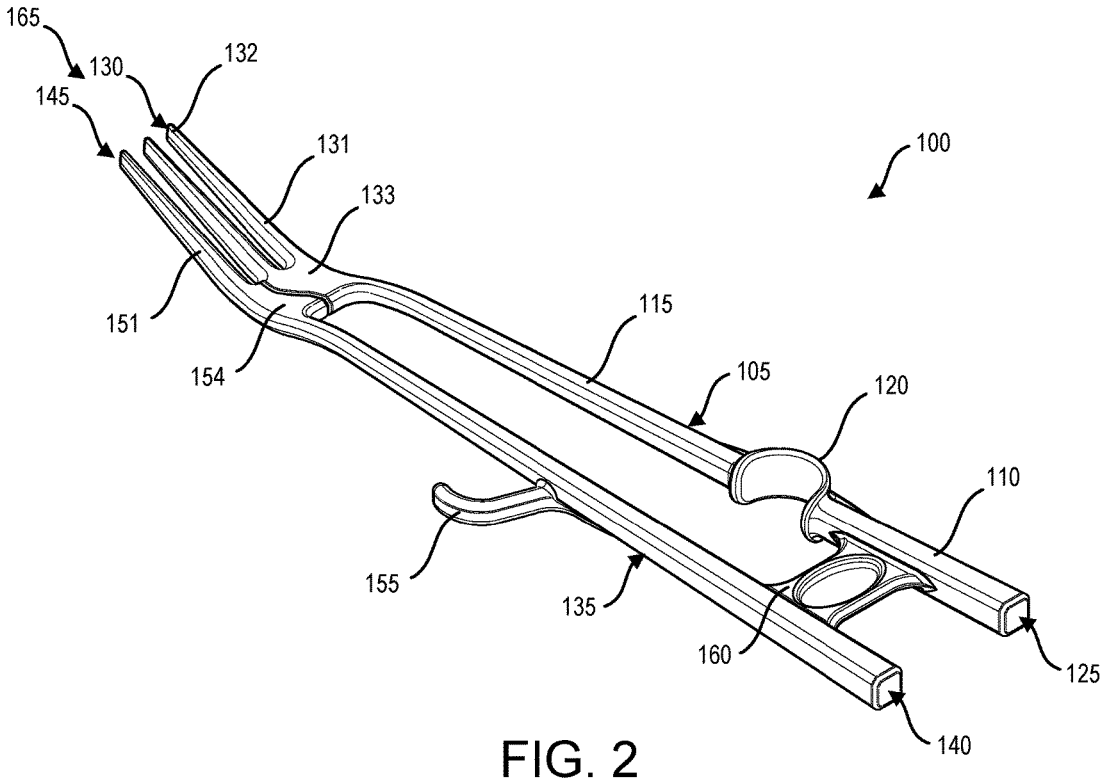
FIG. 2 shows a front perspective view of the eating utensil of FIG. 1
Figure 3:
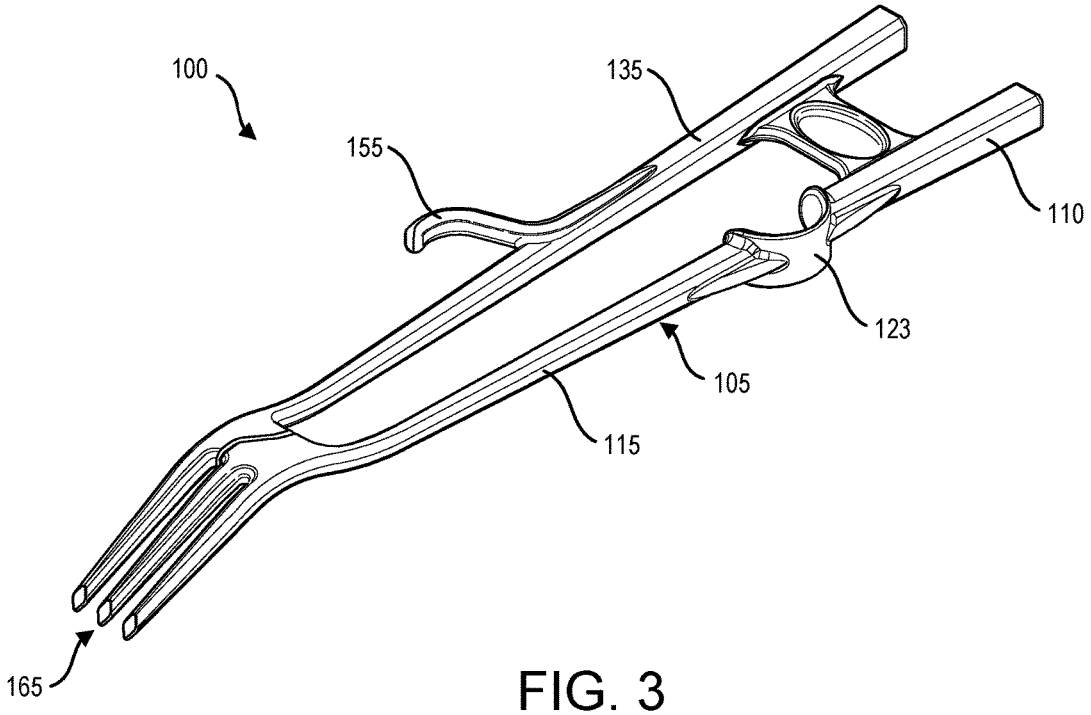
FIG. 3 shows a rear perspective view of the eating utensil of FIG. 1.
Figure 4:
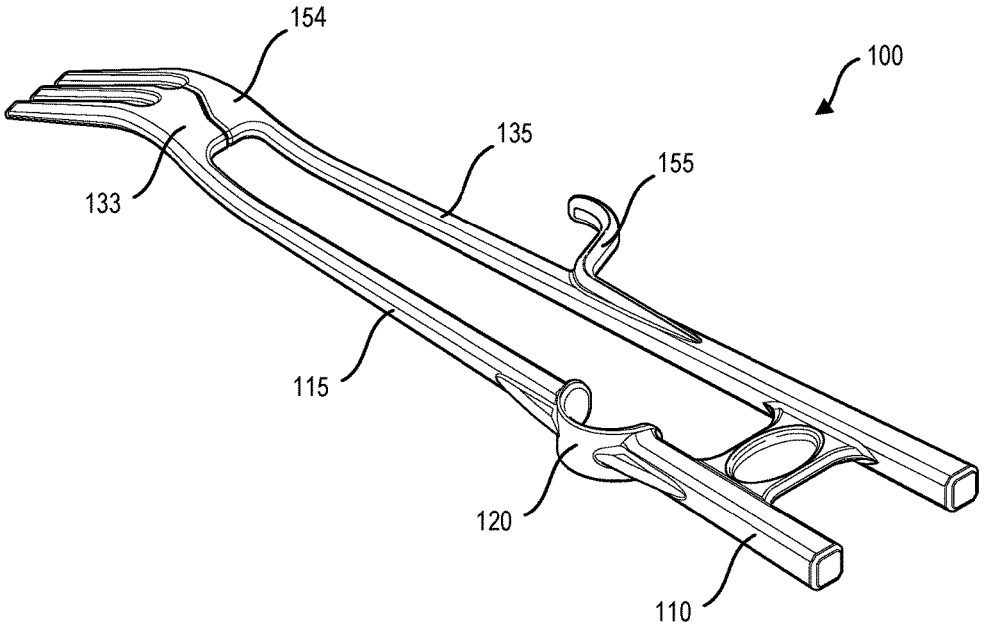
FIG. 4 shows a rear perspective view of the eating utensil of FIG. 1.

As shown in FIG. 2, the eating utensil 100 can include an upper elongated member 105. The upper elongated member 105 can include a stationary portion 110 and a movable portion 115 connected by a flexible member 120, such as a hinge. The stationary portion 110 can extend from a stationary end 125 of the upper elongated member to the hinge 120. The movable portion 115 can extend from the hinge 120 to a tine end 130 of the upper elongated member 105.

The eating utensil 100 can include a lower elongated member 135 having a stationary end 140 and a tine end 145 opposite the stationary end. The lower elongated member 135 can be connected to the upper elongated member 105 by a cross member 160. In one example, shown in FIG. 2, the lower elongated member 135 can taper along its length from the stationary end 140 to the tine end 145 and have a tapered shape that is similar to a traditional chopstick, resulting in the utensil feeling comfortable to a chopsticks user.

The hinge 120 shown in FIGS. 1-17 was developed after studying the natural hand movements of chopsticks users. The hinge 120 provides unique functionality that allows the eating utensil 100 (with unitary construction) to mimic the movements of two traditional, unconnected chopsticks. This is accomplished, in part, by matching a pivot point 180 location of traditional chopsticks and by providing suitable stiffness in the hinge 120 to prevent out-of-plane motion of the movable portion 115 of the upper elongated member 105.

Figure 18:
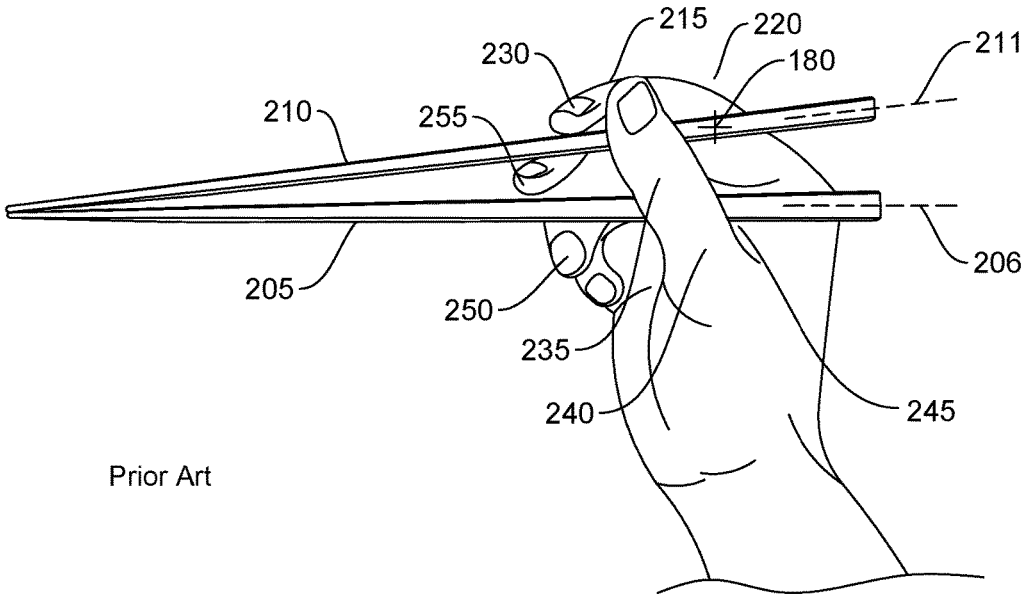
FIG. 18 shows traditional chopsticks held by a user in a closed position.
Figure 19:
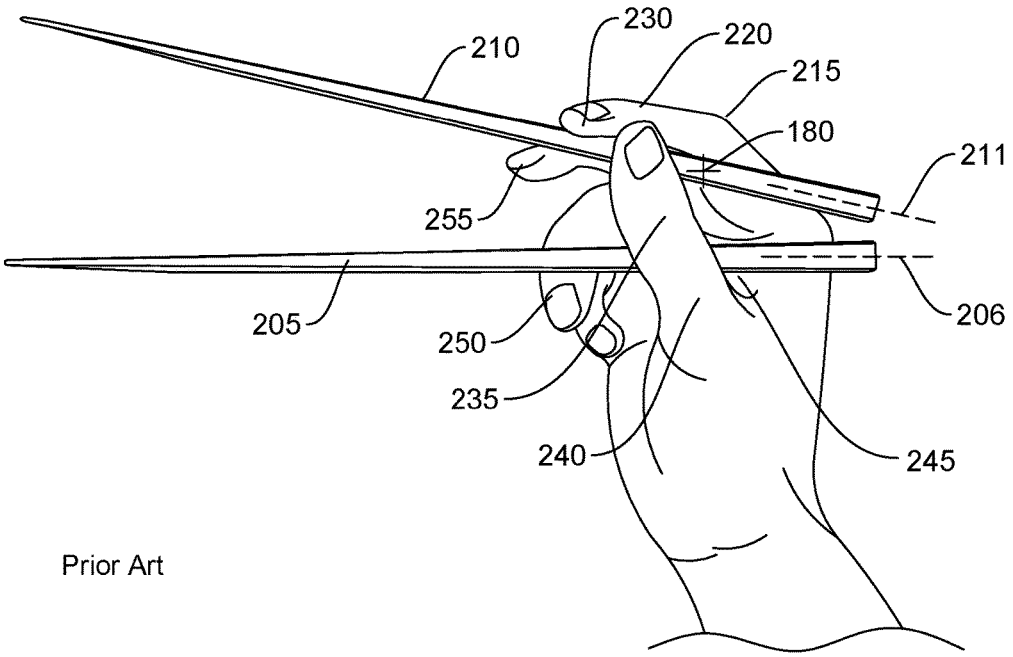
FIG. 19 shows traditional chopsticks held by a user in an open position.
Figure 20:
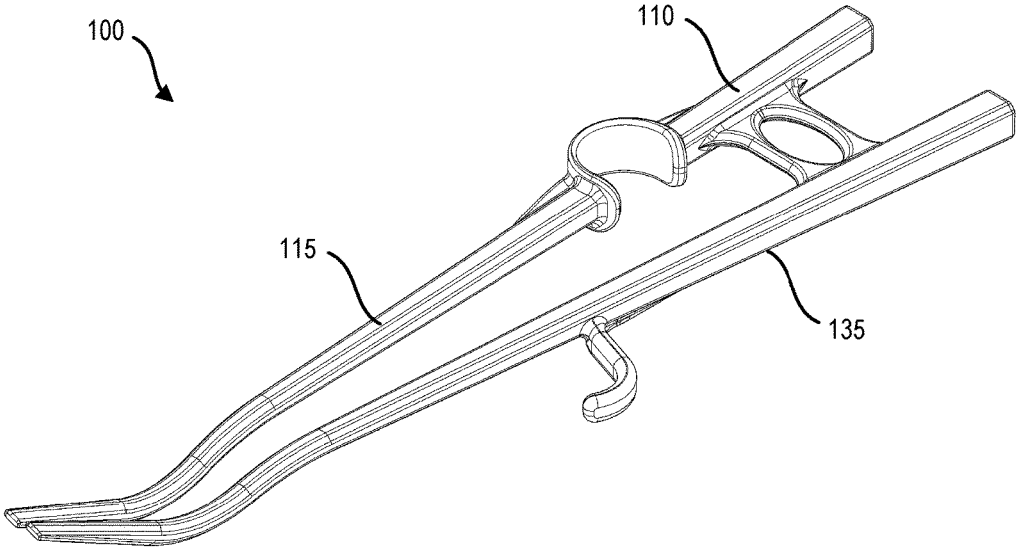
FIG. 20 shows a front perspective view of an eating utensil.
Figure 21:
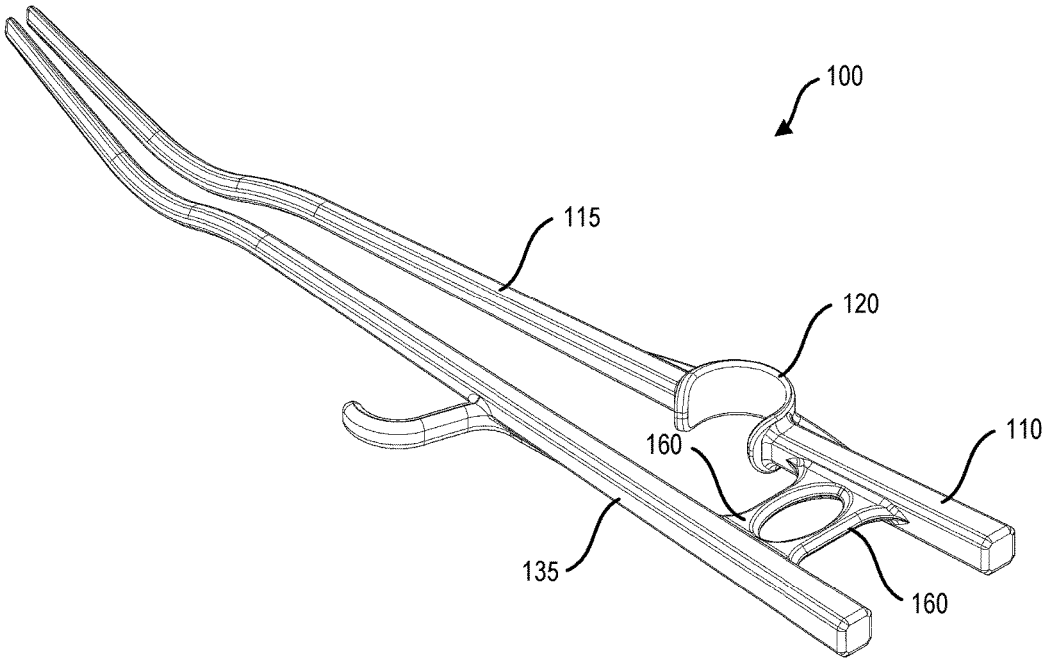
FIG. 21 shows a front perspective view of the eating utensil of FIG. 20.
Figure 22:
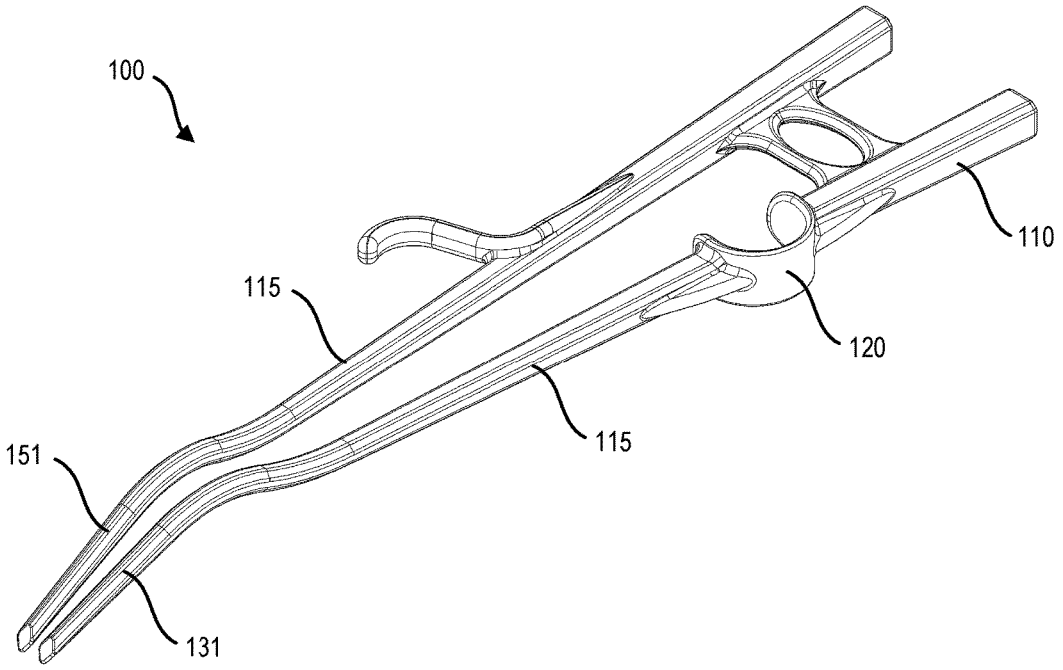
FIG. 22 shows a rear perspective view of the eating utensil of FIG. 20.
Figure 23:
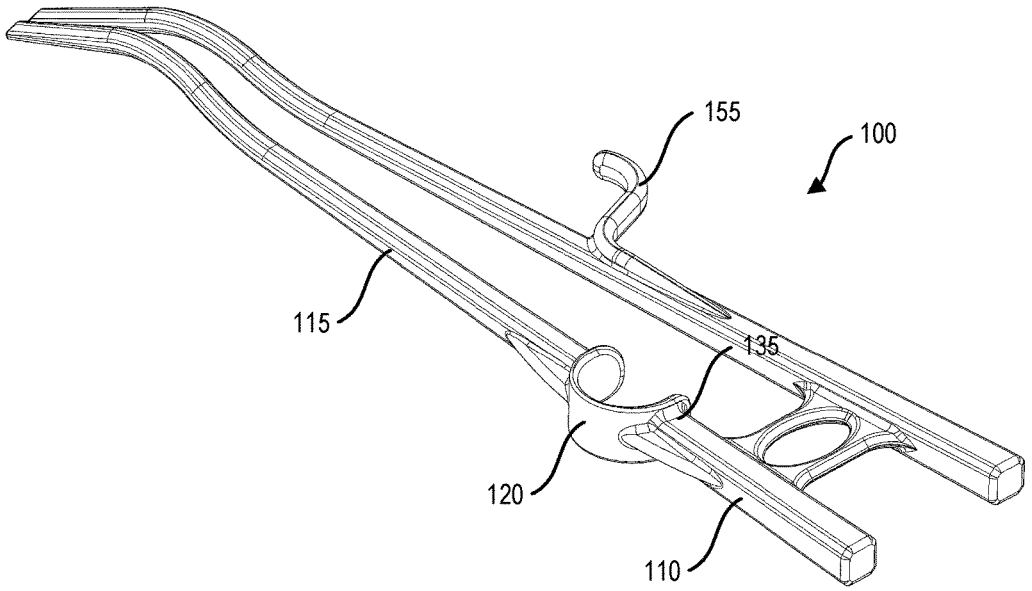
FIG. 23 shows a rear perspective view of the eating utensil of FIG. 20.

FIG. 18 shows traditional chopsticks held in a closed position by a user, and FIG. 19 shows traditional chopsticks held in an open position by a user. A pivot point 180 is shown in FIGS. 18 and 19 and is represented by a plus sign. During use, the first chopstick 205 remains stationary. The lower chopstick 205 is held in a trough 245 between the thumb 240 and index finger 230 and is supported a distance away from the trough by the ring finger 250. The upper chopstick 210 is held like a pencil, using tips of the thumb 240, index finger 230, and middle finger 255. During use, the upper chopstick 210 is moved relative to the first chopstick 205 to pick up pieces of food between the tips of the opposing chopsticks. As the upper chopstick moves, it rotates relative to the pivot point 180.

For most users, the pivot point 180 of the upper chopstick 210 is horizontally located between a proximal inter-phalangeal (PIP) joint 220 and a distal inter-phalangeal (DIP) joint 215 of the index finger 230 and is vertically located below the top surface of the index finger 230 and above the inter-phalangeal joint 235 of the thumb 240, as shown in FIGS. 18 and 19. For some users, the pivot point 180 may be horizontally located closer to the proximal inter-phalangeal joint 220 than the distal inter-phalangeal joint 215, as shown in FIGS. 18 and 19. For other users, the pivot point 180 may be horizontally located closer to the distal inter-phalangeal joint 215 than the proximal inter-phalangeal joint 220. The precise location of the pivot point 180 may vary and may depend on several factors, including the size and shape of the user's hand, the length of the user's fingers, and the length of the chopsticks. FIGS. 18 and 19 show standard size chopsticks held by an adult.

The eating utensil 100 is configured to mimic the feel of traditional chopsticks. This is accomplished, in part, by matching the pivot point 180 location of traditional chopsticks, thereby permitting a hand motion that feels natural and comfortable to traditional chopsticks users. FIG. 5 shows the eating utensil 100 held by a user in a normally closed position, and FIG. 6 shows the eating utensil held in an open position. The location of the pivot point 180 shown in FIGS. 5 and 6 is in a similar or identical location as the pivot point 180 of the chopsticks shown in FIGS. 18 and 19, with respect to the user's hand.

FIGS. 5 and 6 show standard size eating utensil 100 held by an adult. The size of the eating utensil can be adjusted to accommodate larger or smaller hand sizes. For the standard size eating utensil shown in FIG. 11, a distance (d1) between a centerline 111 of the stationary portion 110 of the upper elongated member 105 and a centerline 150 of the lower elongated member 135 can be about 0.75-1.75, 1-1.5, or preferably about 1.25 in. A distance (d2) between the pivot point 180 of the hinge 120 and a stationary end 125 of the stationary portion 110 of the upper elongated member 105 is about 1.25-3.25, 1.5-3, 1.75-2.75, 2-2.5, or preferably about 2.25 in. A distance (d3) between the pivot point 180 of the hinge 120 and the centerline 150 of the lower elongated member 135 can be about 0.5-1.5, 0.75-1.25, or preferably about 1 in.

The hinge 120 can be a movable joint or mechanism that allows the movable portion 115 of the upper elongated member 115 to move relative to the stationary portion 110 of the upper elongated member when a user applies a separating force to the movable portion, as shown in FIG. 6.

While the hinge 120 can permit certain movements of the movable portion 115 of the upper elongated member 105, it can also serve to restrict other movements of the movable portion to enhance performance. For example, during use of the eating utensil 100, to ensure the tine ends (130, 145) of the upper and lower elongated members meet to form a properly aligned fork end 165, the hinge 120 can restrict movement of the movable portion 115 to a single plane of motion by only permitting movement relative to a first hinge axis 121 and restricting movement relative to a second hinge axis 122, as shown in FIG. 32.

Figure 30:
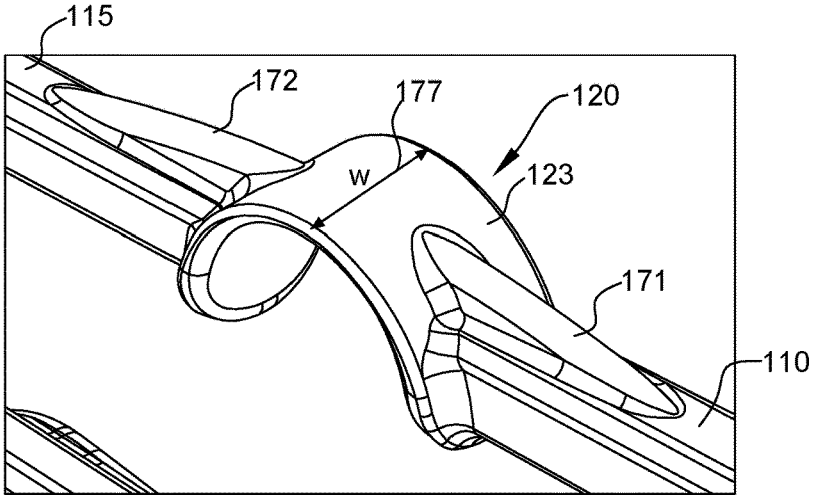
FIG. 30 shows an enlarged perspective view of the hinge of the eating utensil of FIG. 1.
Figure 31:
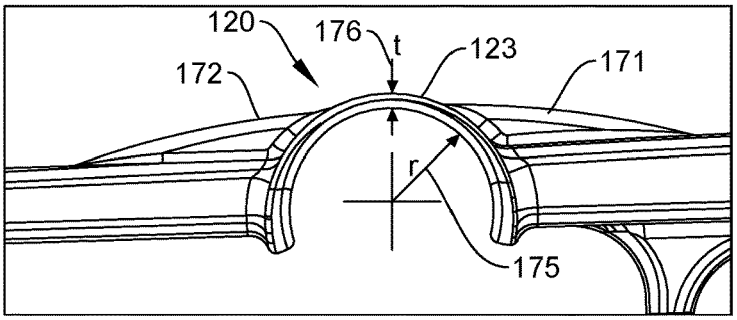
FIG. 31 shows an enlarged front view of the hinge of the eating utensil of FIG. 1.
Figure 32:
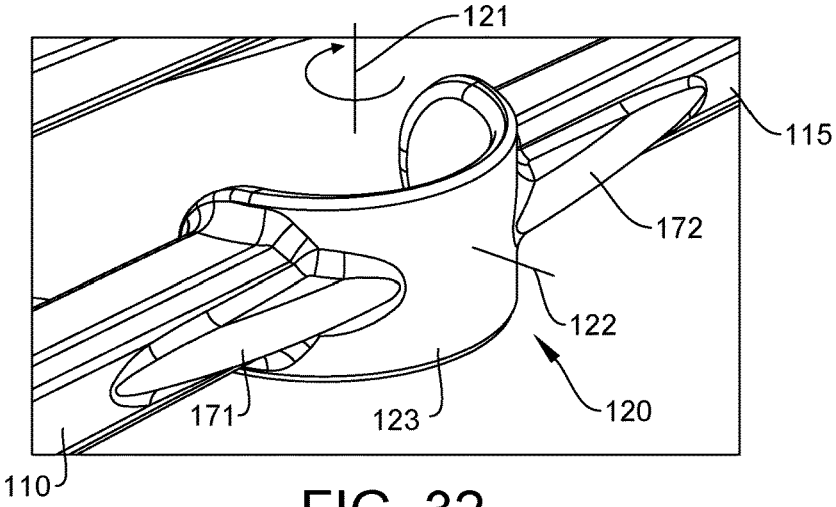
FIG. 32 shows an enlarged perspective view of the hinge of the eating utensil of FIG. 1.

As shown in FIGS. 30-32, the hinge 120 can include a curved beam 123 connecting the movable portion 115 to the stationary portion 110 of the upper elongated member 105. The curved beam 123 can function like a leaf spring to withstand many cycles without appreciable damage or functional deterioration. Due to the shape of the curved beam 123, the hinge 120 can permit rotation about the first hinge axis 121 and resist rotation about the second hinge axis 122. Therefore, the curved beam can have low bending stiffness (i.e. flexural rigidity) about the first hinge axis 121 and high bending stiffness about the second hinge axis 122, where bending stiffness is defined as a resistance against bending deformation. The width of the curved beam 123 can be large enough to provide high bending stiffness about the second hinge axis 122 while small enough to not interfere with a user's index finger during use of the eating utensil. To ensure these attributes, the curved beam 123 can have a width of about 0.25-0.75, 0.25-0.50, or 0.25-0.375 in. The curved beam 123 can have a thickness of about 0.03-0.125, 0.0625-0.125, or 0.125-0.1875. In a preferred embodiment, the curved beam can have a width of about 0.375-0.5 and a thickness of about 0.0625. The properties of the material selected for the hinge can dictate the dimensions of the hinge. The dimensions above are suitable for a polymer material, such as polypropylene (PP) or high-density polyethylene (HDPE), which are food grade plastics. For materials with higher strength, the dimensions can be reduced. For materials with lower strength, the dimensions can be increased.

Due to the shape of the curved beam 123, the hinge 120 can permit rotation about the first hinge axis 121 and resist rotation about the second hinge axis 122. As shown in FIG. 31, the curved beam 123 can have a radius 175. The radius 175 can be measured from the first hinge axis 121 to a lower surface of the hinge. In some examples, the radius 175 of the curved beam 123 can be about 0.125-0.75, 0.125-0.5, 0.125-0.375, or 0.1875-0.3 in. In a preferred embodiment, the curved beam 123 can have a radius of about 0.25 in.

The hinge 120 can be formed of a polymer material or other suitable material. The hinge 120 can be integrally formed in the upper elongated member 105, thereby enabling use of low-cost manufacturing methods, such as injection molding or 3D printing, to manufacture the eating utensil. Minimizing the cost of the eating utensil 100 is desirable to allow the eating utensil to be a suitable replacement for disposable or reusable forks, sporks, and chopsticks at restaurants, concerts, festivals, and other eateries and events.

As shown in FIG. 30, the hinge 120 can include structural ribs. A first structural rib 171 can extend from an outer surface of the stationary portion 110 of the upper elongated member 105 to an outer portion of the hinge 120. A second structural rib 172 can extend from an outer surface of the movable portion 115 of the upper elongated member 105 to an outer portion of the hinge 120. The structural ribs (171, 172) can enhance the structural integrity of the upper elongated member 105 and prevent unwanted lengthwise flexing or out-of-plane motion.

The hinge 120 can be configured to exert a spring force that maintains the eating utensil 100 in a normally closed position, meaning that when no force is exerted on the eating utensil by a user, the eating utensil will remain in a closed position, as shown in FIGS. 1-4, with the upper tine end 130 in contact with the lower tine end 145 to form a fork end 165. This configuration allows the eating utensil 100 to serve as a fork when in the closed position without the user having to exert a compressive force on the elongated members to keep the upper tine end 130 in contact with the lower tine end 145. Since traditional fork users may be unskilled at using chopsticks when they first encounter the eating utensil 100, ensuring that the eating utensil's default configuration is to function as a fork without the user having to manipulate the utensil in any way is desirable to allow the eating utensil to be adopted by fork users who are unskilled at using chopsticks. As the user gains comfort with the eating utensil 100, they can begin to practice hand movements described herein that allow the eating utensil to perform like chopsticks and allow for additional capabilities, such as scooping under food from both sides, that are not possible with a fork or chopsticks.

To transition the eating utensil 100 from a closed position (shown in FIG. 5) to an open position (shown in FIG. 6), a separating force must be exerted on the movable portion 110 of the upper elongated member 105 to overcome the spring force of the hinge 120. As shown in FIG. 6, by applying a separating force with a thumb, index, and middle finger, the user can separate the upper tine end 130 of the upper elongated member 105 from the lower tine end 145 of the lower elongated member 135. The eating utensil 100 can then be used like chopsticks by moving the upper tine end 130 toward the lower tine end 145 to grasp food.

Figure 7:
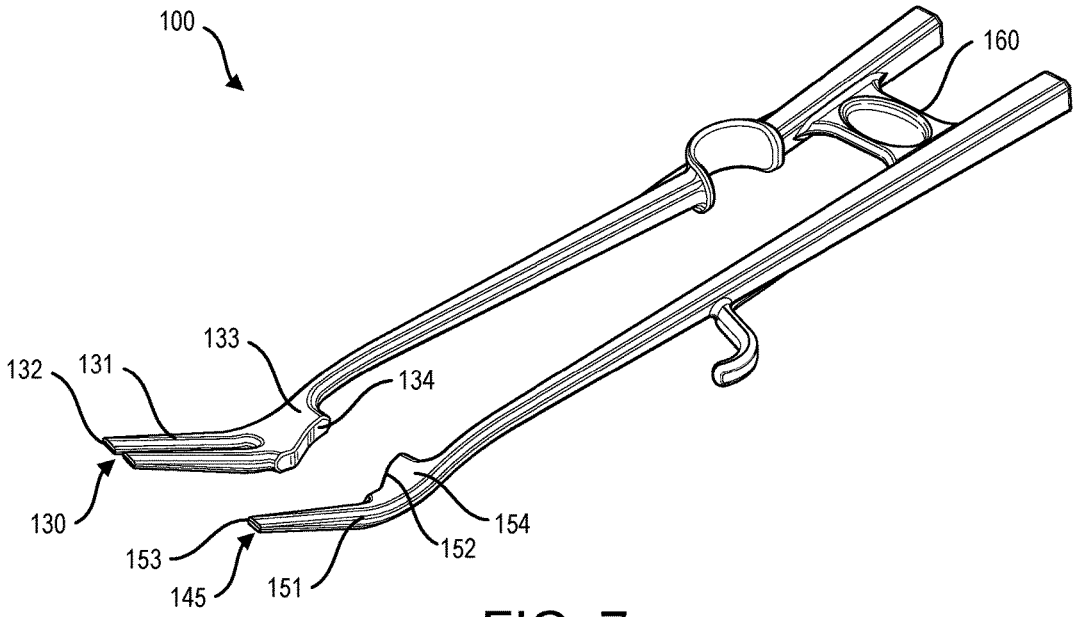
FIG. 7 shows a front perspective view of the eating utensil of FIG. 1 in an open position.
Figure 8:
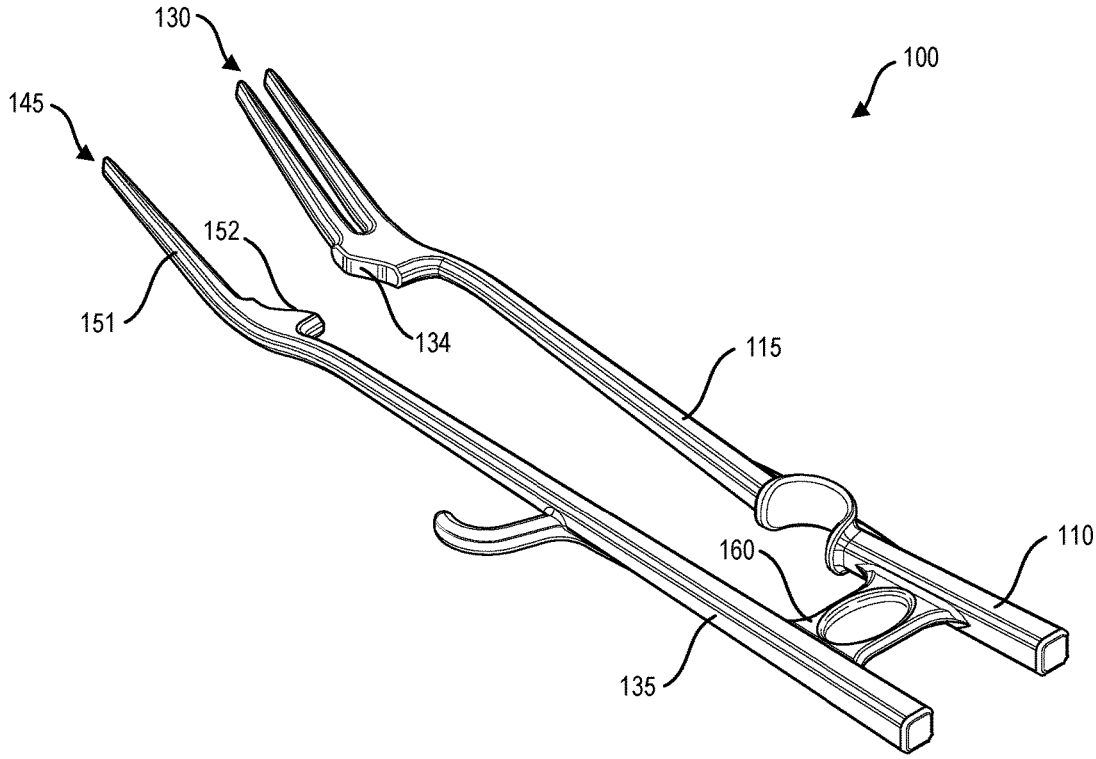
FIG. 8 shows a front perspective view of the eating utensil of FIG. 1 in an open position.
Figure 9:
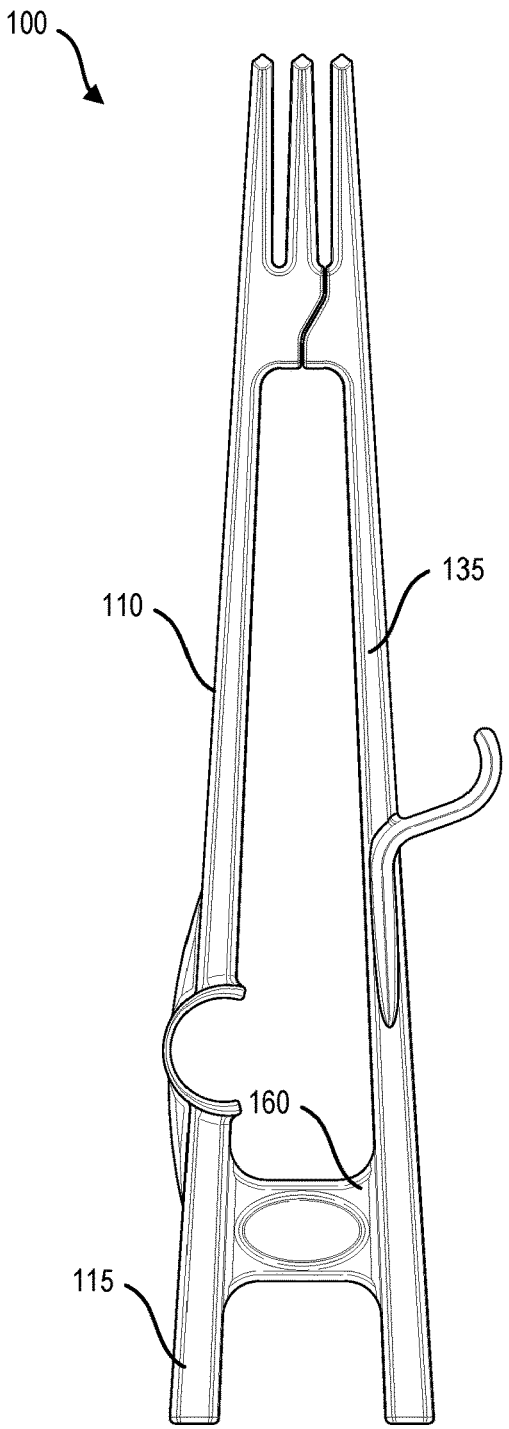
FIG. 9 shows a rear view of the eating utensil of FIG. 1.
Figure 10:
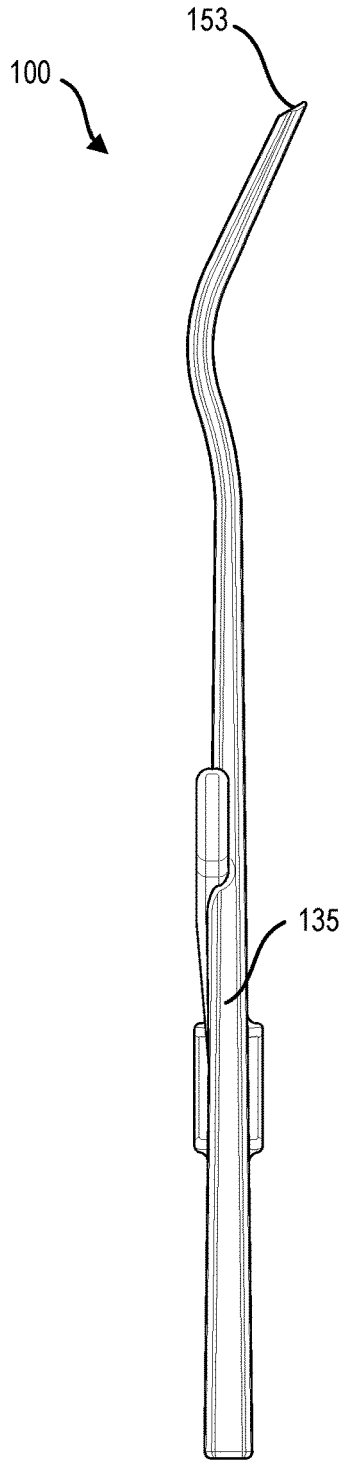
FIG. 10 shows a left side view of the eating utensil of FIG. 1.
Figure 11:
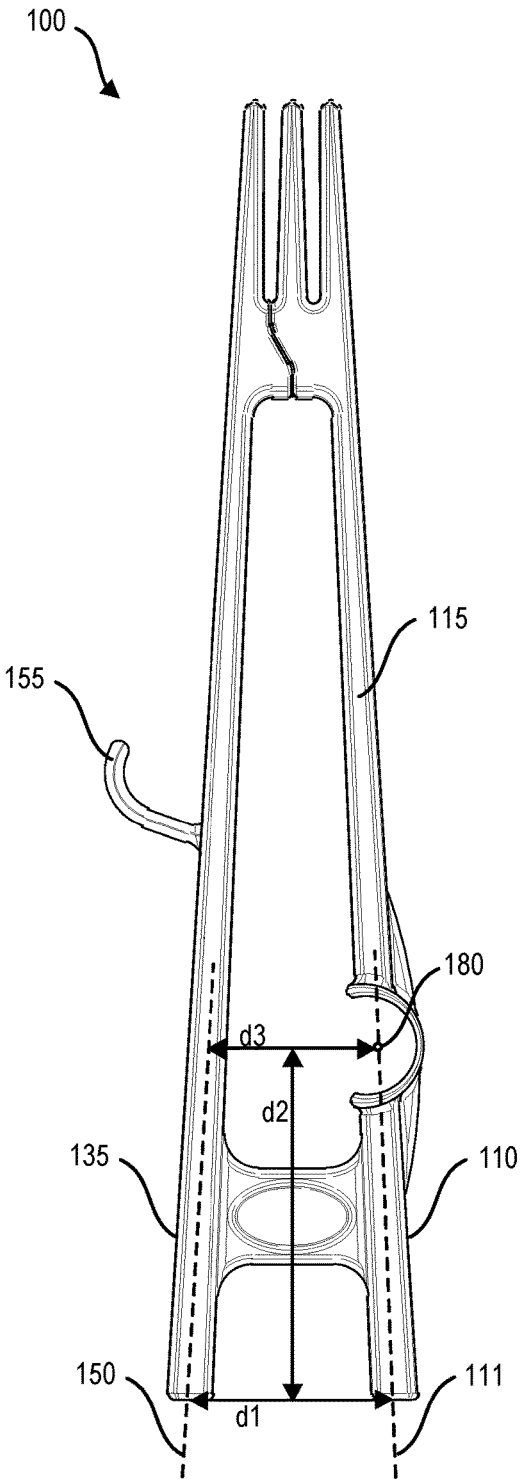
FIG. 11 shows a front view of the eating utensil of FIG. 1.
Figure 12:
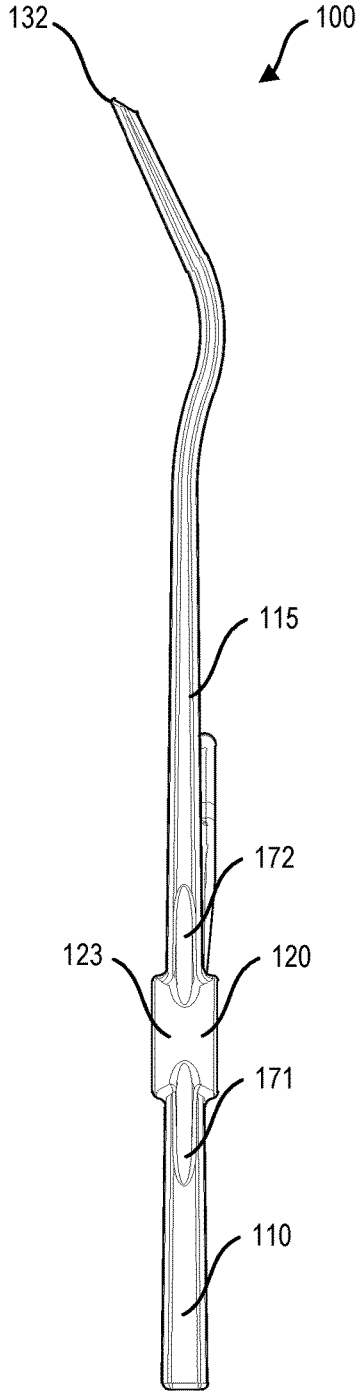
FIG. 12 shows a right side view of the eating utensil of FIG. 1.
Figure 13:
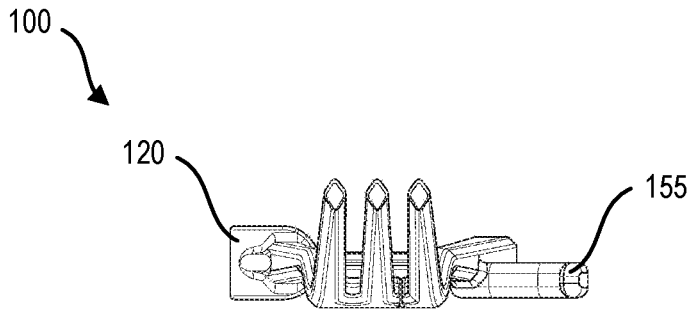
FIG. 13 shows a top view of the eating utensil of FIG. 1.
Figure 14:
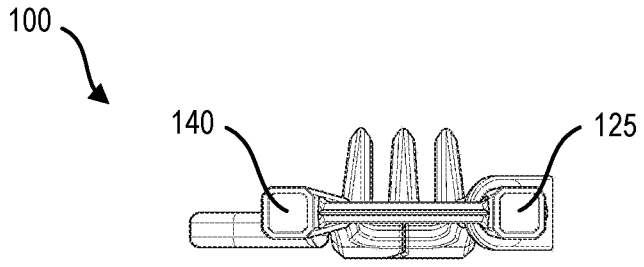
FIG. 14 shows a bottom view of the eating utensil of FIG. 1.
Figure 15:
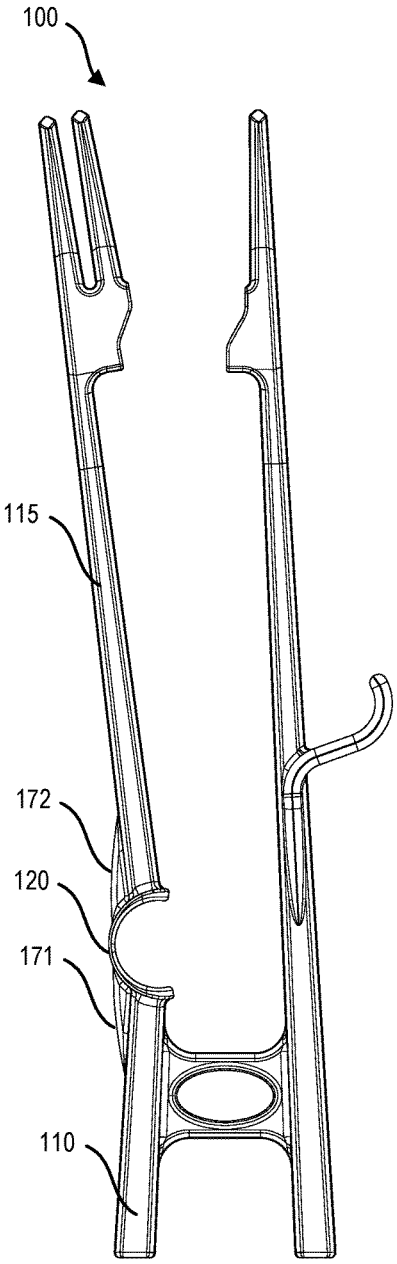
FIG. 15 shows a rear view of the eating utensil of FIG. 1 in an open position.
Figure 16:
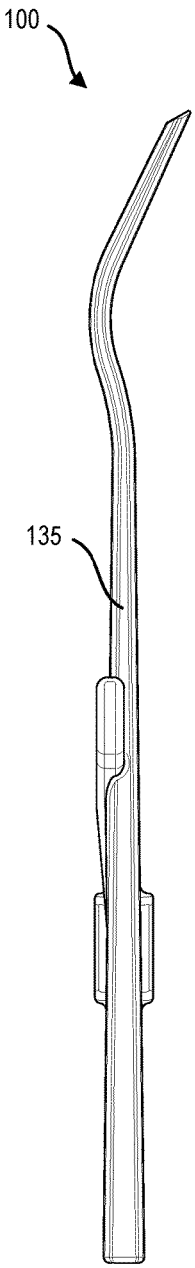
FIG. 16 shows a left side view of the eating utensil of FIG. 1 in an open position.
Figure 17:
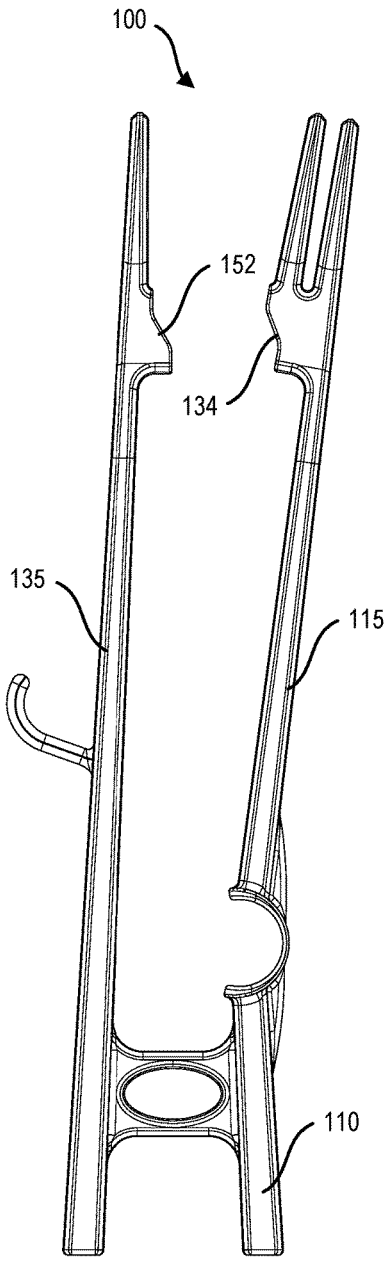
FIG. 17 shows a front view of the eating utensil of FIG. 1 in an open position.

Each tine end (130, 145) can have one or more tines (131, 151). Each tine (131, 151) can extend from a tine base (133, 154) to a tine tip (132, 153), as shown in FIG. 7. In the example shown in FIG. 2, the lower tine end 145 has one tine 151, and the upper tine end 130 has two tines 131. In another example, the lower tine end can have two tines, and upper tine end can have one tine. When the eating utensil 100 is in the closed position, a mating surface 134 of the upper tine end 130 can be in contact with a mating surface 152 of the lower tine end 145 to form a fork end 165 that allows the eating utensil to function like a fork and shovel food in a way that traditional fork users are accustomed to.

FIGS. 5 and 6 show angles that are formed by intersecting centerlines of the movable portion 115 of the upper elongated member, stationary portion 110 of the upper elongated member 105, and lower elongated member 135. Angle A1 is an angle formed at an intersection of a centerline 150 of the lower elongated member 135 and a centerline 111 of the stationary portion 110 of the upper elongated member 105. In some examples, angle A1 can have a range of about 5-25 or 5-15 degrees. Angle B1 is an angle formed at an intersection of the centerline 111 of the stationary portion 110 and a centerline 116 of the movable portion 115 of the upper elongated member 105. Alternately, Angle B1 is an angle formed at an intersection of the centerline 116 of the movable portion 115 and a centerline 111 of the stationary portion 110 of the upper elongated member 105. Angle B1 can be zero degrees in the closed position shown in FIG. 5. In some examples, angle B1 can be about 5-45, 5-15, 15-45, or 15-30 degrees in the open position shown in FIG. 6. Angle B2 is an angle formed at an intersection of the centerline 150 of the lower elongated member 135 and the centerline 116 of the movable portion 115 of the upper elongated member 105. In some examples, angle B2 can be about 15-45 or 15-25 degrees in the open position shown in FIG. 6.

The cross member 160 can be a rigid member that substantially restricts movement of the stationary portion 110 relative to the lower elongated member 135. The cross member 160 can position the stationary portion 110 of the upper elongated member 105 a distance (d1) from the lower elongated member 135 that provides a comfortable feel for traditional chopsticks users. The distance (d1) can be similar to the distance between the ends of the chopsticks shown in FIG. 18. The distance (d1) can be about 0.75-1.75, 1-1.5, or preferably about 1.25 in.

The cross member 160 can include two members extending between the stationary portion 110 of the upper elongated member 115 and the lower elongated member 135, as shown in FIG. 2. In other examples, the cross member 160 can have one member or more than two members extending between the stationary portion 110 of the upper elongated member and the lower elongated member 135. The cross member 160 can maintain a centerline 111 of the stationary portion 110 of the upper elongated member 105 in the same plane as a centerline 150 of the lower elongated member 135 to avoid unwanted lengthwise twisting or out-of-plane motion of the movable portion 115 of the utensil during use. The cross member 160 can serve as a structural support between the upper and lower elongated members (105, 135) to avoid unwanted misalignment of the mating surfaces (134, 152) of the tine ends (130, 145) during use.

In one alternative embodiment shown in FIGS. 33 and 34, the lower elongated member 135, upper elongated member 105, and cross member 160 may form a continuous structure where there are no distinct breaks or separations between adjacent elements. The cross member can be an arc-shaped member that connects the lower elongated member 135 to the upper elongated member 105. The operation of the eating utensil 100, recommended hand position, and angles between respective centerlines can be the same as shown in FIG. 7 and described herein. The location and dimensions of the hinge 120 can be the same as shown in FIGS. 11 and 30-32 and described herein.

In another alternative embodiment shown in FIGS. 35 and 36, the upper elongated member 105 may not include a stationary portion 110. The hinge 120 may instead be directed connected to the lower elongated member 135. The operation of the eating utensil 100, recommended hand position, and angles between respective centerlines can be the similar to those shown in FIG. 7 and described herein. The location and dimensions of the hinge 120 can be similar to those shown in FIGS. 11 and 30-32 and described herein.

Figure 24:
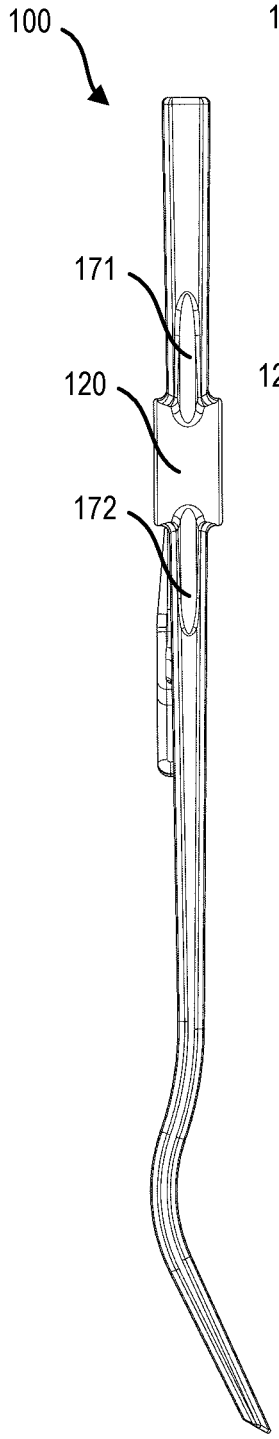
FIG. 24 shows a right side view of the eating utensil of FIG. 20.
Figure 25:
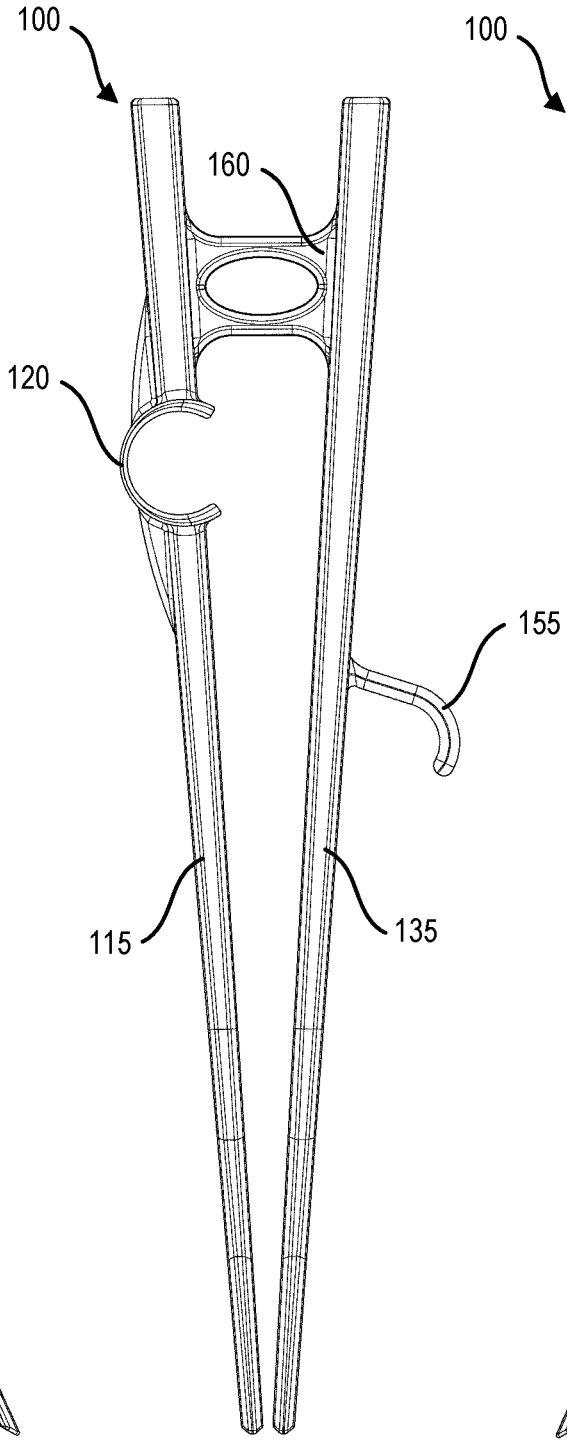
FIG. 25 shows a top view of the eating utensil of FIG. 20.
Figure 26:
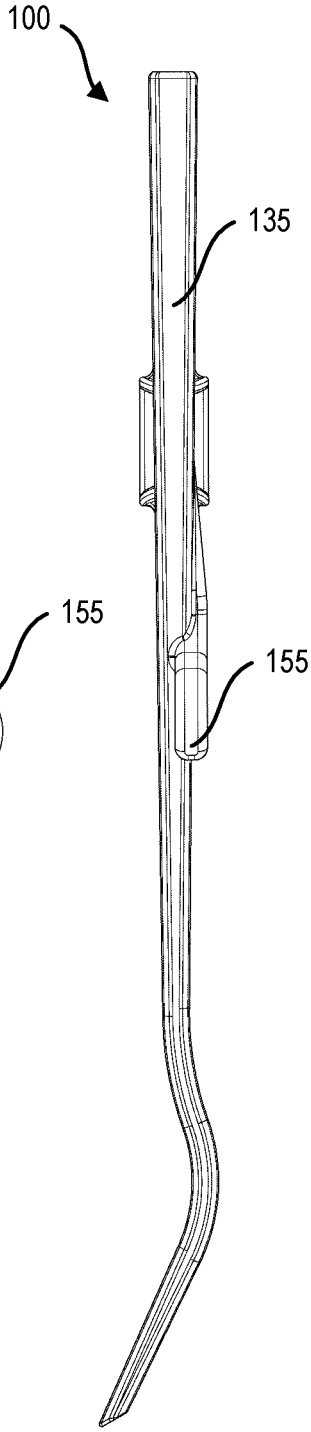
FIG. 26 shows a left side view of the eating utensil of FIG. 20.
Figure 27:
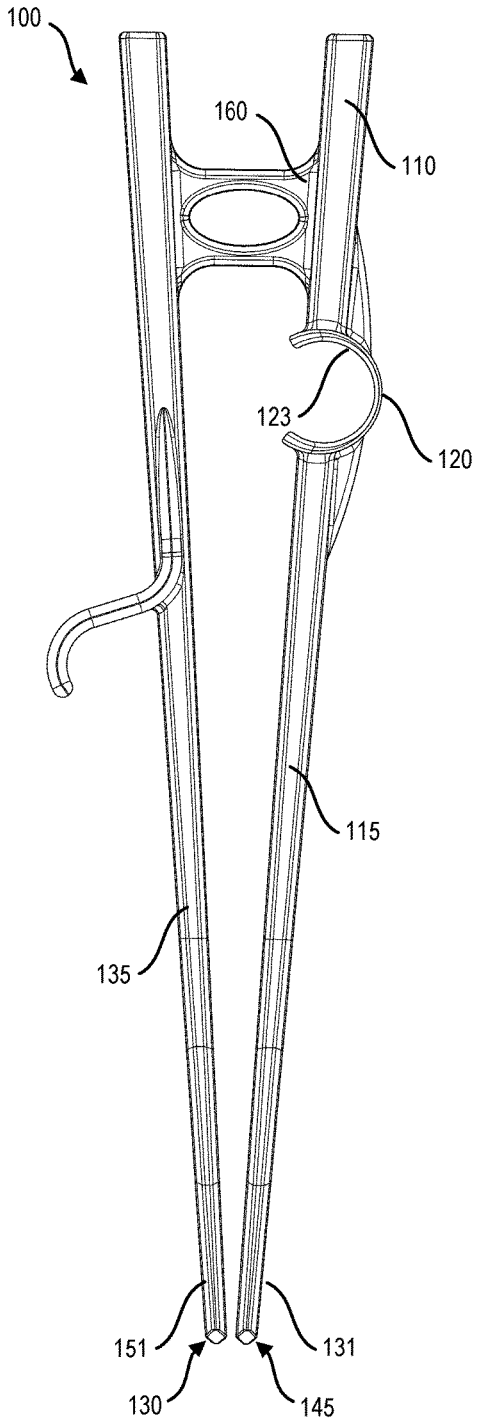
FIG. 27 shows a rear view of the eating utensil of FIG. 20.
Figure 28:
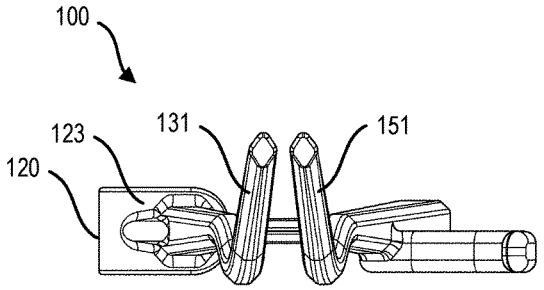
FIG. 28 shows a top view of the eating utensil of FIG. 20.
Figure 29:
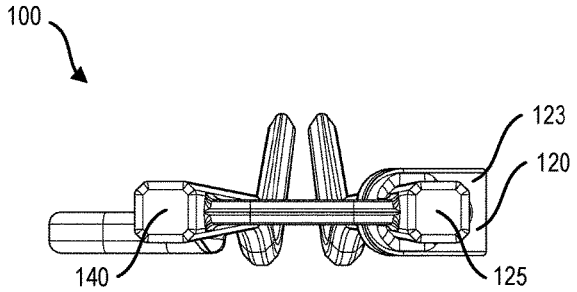
FIG. 29 shows a bottom view of the eating utensil of FIG. 20.

The eating utensil 100 can include one or more tines 131 extending from the upper elongated member 105 proximate the upper tine end 130. In the example shown in FIG. 2, the eating utensil 100 can have two tines 131 extending proximate the upper tine end 130. In another example, shown in FIGS. 20-29, the eating utensil 100 can have one tine 131 extending proximate the upper tine end 130 and one tine 151 extending proximate the lower tine end 145. Rather than having straight ends like traditional chopsticks, the tine ends can each have an S-curve, as shown in FIGS. 24 and 26, similar to tines of a traditional fork. The curved tines can allow the eating utensil 100 to scoop under food, which is not possible with straight ends of traditional chopsticks.

The eating utensil can have a finger rest 155 extending from the lower elongated member 135. The finger rest 155 can have a curved shape that is configured to receive a user's ring finger 250, as shown in FIGS. 5 and 6. The finger rest 155 can provide a user with greater control of the eating utensil. The finger rest 155 can also serve as a locating feature that ensures the eating utensil is properly located in the user's hand. The finger rest 155 can also increase adoption of the eating utensil 100 by making it feel more comfortable to a user who is unskilled at using chopsticks. In some examples, the finger rest 155 may be eliminated, for example, to reduce manufacturing costs or to provide a form factor that is easier to package and ship.

As shown in FIG. 2, the tines 131 of the eating utensil can have a curved shape, similar to tines of a traditional fork, to allow the tines to scoop under food during use. Each tine 131 can have a relatively narrow or sharp tine tip 132 for piercing food and a relatively wide tine base 133 to provide stiffness, thereby minimizing or eliminating deflection of the tine when cutting food with an edge of the tine. The tine 131 can taper along its length between the tine base 133 and the tine tip 132. In the example shown in FIG. 10, the tine tip 132 can be beveled to provide a sharp point for piercing food while providing sufficient thickness along the tine to ensure structural integrity and stiffness, even when the tines are made of a nonmetal material, such as wood, bamboo, or plastic. In other examples, the tines can be made of metal, such as stainless steel, aluminum, or other suitable metal.

In one example shown in FIGS. 1-17 and 30-32, an eating utensil 100 can be operable with one hand and capable of scooping under food from opposing directions. The eating utensil 100 can include a lower elongated member 135 having a lower tine end 145, an upper elongated member 105 having a stationary portion 110, a movable portion 115 with an upper tine end 130, and a hinge 120 between the stationary portion 110 and the movable portion 115. The eating utensil 100 can include a cross member 160 connecting the lower elongated member 135 to the stationary portion 110 of the upper elongated member 105. The hinge 120 can have a spring force configured to maintain the eating utensil in a closed position with the upper tine end 130 of the movable portion 115 of the upper elongated member 105 in contact with the lower tine end 145 of the lower elongated member 135 to form a fork end 165 when the eating utensil is in the closed position, as shown in FIG. 2. The movable portion 115 of the upper elongated member 105 can be movable relative to the lower elongated member 135 by actuation of the hinge 120, thereby allowing the eating utensil to transition between an open position and the closed position and thereby grasp food between the upper and lower tine ends (130, 145) and scoop under food from opposing directions. The hinge 120 can include a curved beam 123 extending from the stationary portion 110 of the upper elongated member 105 to the movable portion 115 of the upper elongated member. The curved beam can have a width of 0.25-0.75 in., a thickness of 0.03-0.1875 in., and a radius of 0.125-0.75 in. The eating utensil can include a first structural rib 171 extending from an outer surface of the stationary portion 110 of the upper elongated member 105 to an outer portion of the hinge 120 and a second structural rib 172 extending from an outer surface of the movable portion 115 of the upper elongated member 105 to the outer portion of the hinge 120. A centerline 116 of the movable portion 115 of the upper elongated member 105 and a centerline 111 of the stationary portion 110 of the upper elongated member can remain in the same plane when the eating utensil is transitioned between the open and closed positions. Movement of the centerline 116 of the movable portion 115 of the upper elongated member 105 defines a plane when the eating utensil is transitioned between the open and closed positions, and a centerline 150 of the lower elongated member 150 can be located in the same plane to ensure proper alignment of the upper and lower tine ends (130, 145) during use. The centerline 116 of the movable portion 115 of the upper elongated member can be collinear with the centerline 111 of the stationary portion 110 of the upper elongated member when the eating utensil is in the closed position. An intersection of the centerline 116 of the movable portion 115 of the upper elongated member and a centerline 150 of the lower elongated member 135 can define an angle (A1) of about 5-25 degrees when the eating utensil is in the closed position. An intersection of the centerline 116 of the movable portion 115 of the upper elongated member and the centerline 111 of the stationary portion 110 of the upper elongated member can define an angle (B1) of about 5-45 degrees when the eating utensil is in the open position. A distance (d2) between a pivot point 180 of the hinge 120 and a stationary end 125 of the upper elongated member 105 is about 1.25-3.25 in. A distance (d3) between a pivot point 180 of the hinge 120 and a centerline 150 of the lower elongated member 135 is about 0.5-1.5 in.

In another example shown in FIGS. 1-17 and 30-32, an eating utensil 100 can include a lower elongated member 135 and an upper elongated member 105. The lower elongated member 135 can be configured to be held in a trough between a thumb and index finger and extend beyond and be supported by a ring finger, as shown in FIGS. 5 and 6. The upper elongated member 105 can include a stationary portion 110, a movable portion 115, and a hinge 120 between the stationary and movable portions, where the movable portion is held between a thumb, index finger, and middle finger, and where the stationary portion of the upper elongated member is connected to the lower elongated member. A spring force of the hinge 120 can maintain the eating utensil 100 in a closed position with an upper tine end 130 of the movable portion 115 of the upper elongated member 105 in contact with a lower tine end 145 of the lower elongated member 135 to form a fork end 165. The movable portion 115 of the upper elongated member 105 can be movable relative to the stationary portion 110 of the upper elongated member by actuation of the hinge to transition the eating utensil to an open position where the upper tine end 130 is spaced apart from the lower tine end 145, as shown in FIG. 6, to allow grasping food between opposing surfaces (134, 152) of the upper and lower tine ends (130, 145). A pivot point 180 of the hinge 120 can be located proximate a proximal inter-phalangeal joint or a distal inter-phalangeal joint of an index finger of a user when transitioning the eating utensil between the open and closed positions. A centerline 116 of the movable portion 115 of the upper elongated member 105 and a centerline 111 of the stationary portion 110 of the upper elongated member can remain in the same plane when transitioning the eating utensil between the open and closed positions. Movement of the centerline 116 of the movable portion 115 of the upper elongated member 105 defines a plane when transitioning the eating utensil 100 between the open and closed positions. The centerline 111 of the stationary portion 110 of the upper elongated member 105 and a centerline 150 of the lower elongated member 135 can be contained in the same plane defined by movement of the movable portion. The eating utensil can include a finger rest extending from the lower elongated member and can be configured to receive the ring finger of the user. An intersection of the centerline 116 of the movable portion 115 of the upper elongated member 105 and a centerline 150 of the lower elongated member 135 can define an angle (A1) of about 5-25 degrees when the eating utensil is in the closed position, as shown in FIG. 5. An intersection of the centerline 116 of the movable portion 115 of the upper elongated member and the centerline 111 of the stationary portion 110 of the upper elongated member can define an angle (B1) of about 5-45 degrees when the eating utensil is in the open position, as shown in FIG. 5.

In yet another example, an eating utensil 100 can be operated as a fork or chopsticks with one hand without reconfiguring or repositioning the eating utensil. The eating utensil can include a lower elongated member 135 and an upper elongated member 105. The lower elongated member can have a lower tine end 145 and one or more tines 151 extending from the lower tine end. The upper elongated member 105 can have a movable portion 115 with an upper tine end 130. The movable portion 115 can be connected to a hinge 120, and the hinge can be connected to the lower elongated member 135. The hinge 120 can be directly connected to the lower elongated member 135 or there may be intervening components. For example, as shown in FIG. 2, the hinge 120 can be connected to a stationary portion 110 that is connected to the lower elongated member 135 by a cross member 160. As shown in FIGS. 33 and 34, the hinge 120 can be connected to a stationary portion 110 that is connected to the lower elongated member 135 by a cross member 160, where the lower elongated member, cross member, and stationary member are formed as one continuous structure. As shown in FIGS. 35 and 36, the hinge 120 can be directly connected to the lower elongated member 135. The hinge 120 can maintain the eating utensil 100 in a normally closed position with the upper tine end 130 in contact with the lower tine end 145 to form a fork end 165 and enable the eating utensil to function as a fork when in the closed position. Applying a separating force to the movable portion 115 of the upper elongated member 105 transitions the eating utensil 100 to an open position where the upper tine end 130 is spaced apart from the lower tine end 145 to enable the eating utensil to function as chopsticks, as shown in FIG. 6.

The elements and method steps described herein can be used in any combination whether explicitly described or not. All combinations of method steps as described herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of 1-10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference to the same extent as if each individual reference were specifically and individually indicated as being incorporated by reference. In case of conflict between the present disclosure and the incorporated references, the present disclosure controls.

As used herein, term "connected to" can describe a first component directly connected to a second component or a first component indirectly connected to a second component by way of one or more intervening components.

The methods and compositions of the present invention can comprise, consist of, or consist essentially of the essential elements and limitations described herein, as well as any additional or optional steps, components, or limitations described herein or otherwise useful in the art.

It is understood that the invention is not confined to the particular construction and arrangement of parts herein illustrated and described, but embraces such modified forms thereof as come within the scope of the claims.

The foregoing description has been presented for purposes of illustration and description. It is not intended to be exhaustive or to limit the claims to the embodiments disclosed. Other modifications and variations may be possible in view of the above teachings. The embodiments were chosen and described to explain the principles of the invention and its practical application to enable others skilled in the art to best utilize the invention in various embodiments and various modifications as are suited to the particular use contemplated. It is intended that the claims be construed to include other alternative embodiments of the invention except insofar as limited by the prior art.

What is claimed is:

1. An eating utensil operable with one hand and capable of scooping under food from opposing directions, the eating utensil comprising:

a lower elongated member having a lower tine end;

an upper elongated member comprising a stationary portion, a movable portion with an upper tine end, and a hinge between the stationary portion and the movable portion; and a cross member connecting the lower elongated member to the stationary portion of the upper elongated member, wherein the hinge has a spring force configured to maintain the eating utensil in a closed position with the upper tine end of the movable portion of the upper elongated member in contact with the lower tine end of the lower elongated member to form a fork end when the eating utensil is in the closed position, and wherein the movable portion of the upper elongated member is movable relative to the lower elongated member by actuation of the hinge, thereby allowing the eating utensil to transition between an open position and the closed position and thereby grasp food between the upper and lower tine ends and scoop under food from opposing directions.

2. The eating utensil of claim 1, wherein the hinge comprises a curved beam extending from the stationary portion of the upper elongated member to the movable portion of the upper elongated member.

3. The eating utensil of claim 2, wherein the curved beam has a width of 0.25-0.75 in., a thickness of 0.03125-0.1875 in., and a radius of 0.125-0.75 in.

4. The eating utensil of claim 2, further comprising:

a first structural rib extending from an outer surface of the stationary portion of the upper elongated member to an outer portion of the hinge; and a second structural rib extending from an outer surface of the movable portion of the upper elongated member to the outer portion of the hinge.

5. The eating utensil of claim 1, wherein a centerline of the movable portion of the upper elongated member and a centerline of the stationary portion of the upper elongated member remain in the same plane when the eating utensil is transitioned between the open and closed positions.

6. The eating utensil of claim 1, wherein the movable portion of the upper elongated member has a centerline, wherein movement of the centerline defines a plane when the eating utensil is transitioned between the open and closed positions, and wherein a centerline of the lower elongated member is located in the same plane.

7. The eating utensil of claim 1, wherein a centerline of the movable portion of the upper elongated member is collinear with a centerline of the stationary portion of the upper elongated member when the eating utensil is in the closed position.

8. The eating utensil of claim 1, wherein an intersection of a centerline of the movable portion of the upper elongated member and a centerline of the lower elongated member defines an angle (A1) of 5-25 degrees when the eating utensil is in the closed position.

9. The eating utensil of claim 1, wherein an intersection of a centerline of the movable portion of the upper elongated member and a centerline of the stationary portion of the upper elongated member defines an angle (B1) of 5-45 degrees when the eating utensil is in the open position.

10. The eating utensil of claim 1, wherein a distance (d2) between a pivot point of the hinge and a stationary end of the upper elongated member is 1.25-3.25 in.

11. The eating utensil of claim 1, wherein a distance (d3) between a pivot point of the hinge and a centerline of the lower elongated member is 0.5-1.5 in.

12. An eating utensil, comprising:

a lower elongated member configured to be held in a trough between a thumb and index finger and extend beyond and be supported by a ring finger; and an upper elongated member comprising a stationary portion, a movable portion, and a hinge between the stationary and movable portions, wherein the movable portion is configured to be held between a thumb, index finger, and middle finger, and wherein the stationary portion of the upper elongated member is connected to the lower elongated member, wherein a spring force of the hinge is configured to maintain the eating utensil in a closed position with an upper tine end of the movable portion of the upper elongated member in contact with a lower tine end of the lower elongated member to form a fork end, and wherein the movable portion of the upper elongated member is movable relative to the stationary portion of the upper elongated member by actuation of the hinge to transition the eating utensil to an open position where the upper tine end is spaced apart from the lower tine end to allow grasping food between the upper and lower tine ends.

13. The eating utensil of claim 12, wherein the hinge has a pivot point that is located proximate a proximal inter-phalangeal joint of the index finger when transitioning the eating utensil between the open and closed positions.

14. The eating utensil of claim 12, wherein the hinge has a pivot point that is located proximate a distal inter-phalangeal joint of the index finger when transitioning the eating utensil between the open and closed positions.

15. The eating utensil of claim 12, wherein a centerline of the movable portion of the upper elongated member and a centerline of the stationary portion of the upper elongated member remain in the same plane when transitioning the eating utensil between the open and closed positions.

16. The eating utensil of claim 12, wherein movement of a centerline of the movable portion of the upper elongated member defines a plane when transitioning the eating utensil between the open and closed positions, and wherein a centerline of the stationary portion of the upper elongated member and a centerline of the lower elongated member are contained in the plane.

17. The eating utensil of claim 12, further comprising a finger rest extending from the lower elongated member and configured to receive the ring finger.

18. The eating utensil of claim 12, wherein an intersection of a centerline of the movable portion of the upper elongated member and a centerline of the lower elongated member defines an angle (A1) of 5-25 degrees when the eating utensil is in the closed position.

19. The eating utensil of claim 12, wherein an intersection of a centerline of the movable portion of the upper elongated member and a centerline of the stationary portion of the upper elongated member defines an angle (B1) of 5-45 degrees when the eating utensil is in the open position.

20. An eating utensil, comprising:

a first elongated member comprising a first tine end and one or more tines extending from the first tine end;

a second elongated member comprising a stationary portion, a movable portion with a second tine end, and a hinge connecting the stationary portion to the movable portion, the hinge having a spring force; and a cross member connecting the first elongated member to the second elongated member;

wherein the spring force of the hinge is configured to maintain the eating utensil in a normally closed position forming a fork end, thereby allowing the eating utensil to function as a fork when in the closed position, and wherein applying a force opposing the spring force to the second elongated member transitions the eating utensil to an open position where the second tine end is spaced apart from the first tine end, thereby allowing the eating utensil to function as chopsticks.

* * * * *